US007530171B2

(12) United States Patent
Baron et al.

(10) Patent No.: US 7,530,171 B2
(45) Date of Patent: May 12, 2009

(54) SHAVING APPARATUS

(75) Inventors: Sint Baron, Drachten (NL); Pieter Herman Klokman, Drachten (NL); Bauke Kalma, Drachten (NL); Thewis Minne Westra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/542,285

(22) PCT Filed: Jan. 12, 2004

(86) PCT No.: PCT/IB2004/050001

§ 371 (c)(1),
(2), (4) Date: Jul. 15, 2005

(87) PCT Pub. No.: WO2004/065078

PCT Pub. Date: Aug. 5, 2004

(65) Prior Publication Data

US 2006/0048390 A1 Mar. 9, 2006

(30) Foreign Application Priority Data

Jan. 20, 2003 (EP) ..... 03100098

(51) Int. Cl.
*B26B 19/14* (2006.01)
*B26B 19/00* (2006.01)

(52) U.S. Cl. ..... 30/43.6; 30/205; 30/346.51; 74/416; 74/664

(58) Field of Classification Search ..... 30/42, 30/43.4, 43.5, 43.6, 205, 206, 263–265, 346.51; 74/74, 416, 417, 664, 665, 665 H, 665 GB, 74/63

See application file for complete search history.

(56) References Cited

U.S. PATENT DOCUMENTS

| | | | | | |
|---|---|---|---|---|---|
| 3,314,146 | A * | 4/1967 | Cooksey | ..... | 30/43.6 |
| 3,844,033 | A * | 10/1974 | Yonkers | ..... | 30/43.5 |
| 3,890,705 | A | 6/1975 | Tietjens | | |
| 4,077,120 | A * | 3/1978 | Herrick et al. | ..... | 30/43.5 |
| 4,257,161 | A * | 3/1981 | Bijl et al. | ..... | 30/43.6 |
| 4,910,869 | A * | 3/1990 | Labrijn | ..... | 30/43.6 |
| 5,129,275 | A * | 7/1992 | Park | ..... | 74/417 |
| 6,722,038 | B2 * | 4/2004 | Visman et al. | ..... | 30/43.6 |

* cited by examiner

*Primary Examiner*—Boyer D. Ashley
*Assistant Examiner*—Edward Landrum

(57) ABSTRACT

A shaving apparatus has plurality of shaving heads, each with a rotatable cutting member (5) associated with and rotatable relative to a shear plate (3). For driving the cutting members (5), a plurality of drive units (9) is provided, each of said units extending at least from drive rim (7) engaged for driving the drive unit to a coupling end (27) coupled to one of the cutting members (5) for transmitting a rotation of the drive unit (9) to the cutting member (5). The drive rims (7) of the drive units (9) are suspended for rotation about axes of rotation (20) that are oriented at angles relative to each other and diverge from each other in a direction from the drive rim (7) to the coupling (27).

11 Claims, 6 Drawing Sheets

SHAVING APPARATUS

Figure 1:
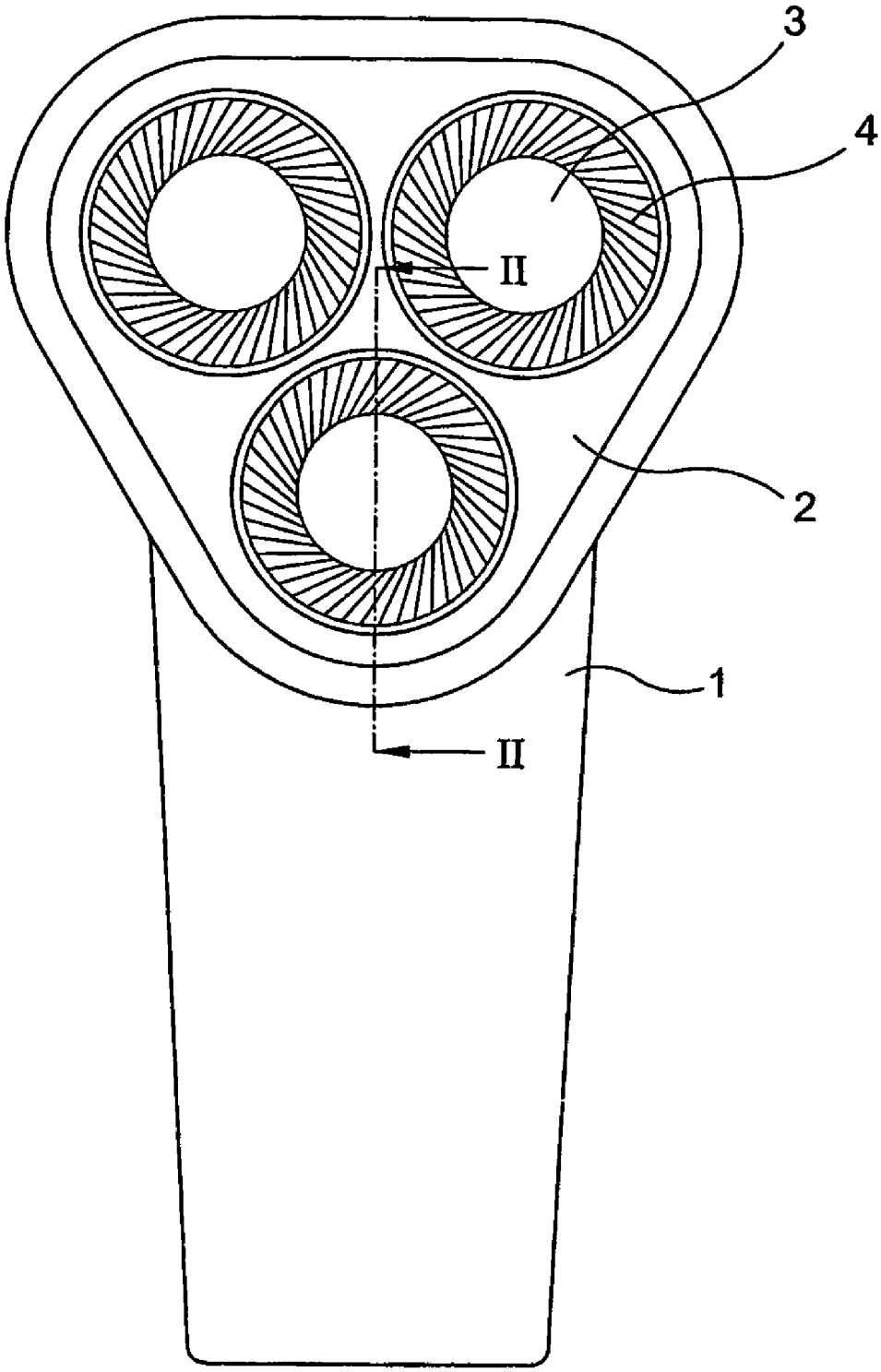

This invention relates to a shaving apparatus comprising:

a plurality of shaving heads, each comprising a circular shear plate provided with hair-entry apertures;

a rotatable cutting member associated with and rotatable relative to the shear plate, a motor, and a drive structure coupling said motor to said cutting members for driving the cutting members into rotation, said drive structure comprising a plurality of drive units, each of said drive units extending at least from a drive rim engaged for driving the drive unit to a coupling end coupled to one of said cutting members for transferring rotation of the drive unit to the cutting member, wherein at least the drive rims of the drive units are each suspended for rotation about an axis of rotation.

Such a shaving apparatus is known from U.S. Pat. No. 4,257,161. According to this document, a shaving apparatus has a floating shaving head comprising a shear plate with hair-entry apertures, a cutting member which is rotatable relative to the shear plate, and a tiltable rotatable coupling spindle which is rotationally coupled at one end to the cutting member and at the other end to a drive mechanism. At at least one end of the coupling spindle, the coupling is a three-point coupling. In one embodiment, the cutting member has three coupling openings which are distributed around the rotational axis of the cutting member, and the coupling spindle is provided with three axially extending coupling members which engage in the respective coupling openings.

The coupling spindle may be provided with a flange which is housed in a cavity in a hub of a gear wheel of the drive mechanism. The flange is movable in the cavity to permit a tilting and axial displacement of the coupling spindle, and three ribs may be formed on the wall of the cavity for respective engagement in three recesses in the periphery of the flange to form a three-point coupling at the other end of the coupling spindle. The ribs are distributed over and extend parallel to the rotational axis of the gear wheel, and the recesses are correspondingly distributed over the rotational axis of the coupling spindle. Such an apparatus allows the axes of rotation of the (usually toothed) drive rims to be offset and preferably closer together than the axes of rotation of the cutting members, so that a compact transmission is obtained. One reason why a compact transmission is advantageous is that it allows the housing to taper from a relatively large shear plate holder to the motor that has a cross-section that is substantially smaller than the surface of the shear-plate holder. However, the coupling spindles that are tiltable relative to the drive rims are oriented at a relatively large angle to each other, to the drive rims, and to the shaving heads. This entails that a specific design of the couplings is required to prevent a limitation of the freedom of tilting of the shaving heads, and to prevent that relatively much friction and wear occurs at the couplings and where the spindles are coupled to the drive rims, even if the difference between the spacing between the axes of rotation of the drive rims and the spacing between the axes of rotation of the cutting members is relatively small. A further consequence is that, on pivoting or mounting of the shear-plate holder into its operating position, the coupling ends of the coupling spindles are out of line with the coupling openings of the cutting members and need to be urged into alignment with the coupling openings against a spring force before engagement with the coupling openings of the cutting members.

U.S. Pat. No. 3,890,705 discloses an apparatus that has a coupling pin at the end of the coupling spindle, which pin engages with a coupling slot in the cutting member with a large amount of play. This allows the cutting member to move back and forth relative to the coupling spindle in the longitudinal direction of the slot, which may cause wear and unpleasant noise.

It is an object of the invention to provide a solution that allows the distance between the centers of the drive rims of the drive units coupled to each of the cutting members to be substantially smaller than the distance between the centers of the cutting members, while at least reducing friction, wear, noise, and tilt obstruction normally associated with prior art apparatuses having tiltable spindles, so as to overcome the offset between, on the one hand, the distances between the centers of the drive rims and, on the other hand, the distances between the centers of the cutting members.

According to the present invention, this object is achieved by providing an apparatus according to claim 1. The mutually diverging orientations of the axes of rotation of the drive rims allow the centers of the cutting members to be spaced apart further than the centers of the drive rims, without requiring the rotatable spindle of each drive unit to extend at an angle relative to the drive rim coupled thereto.

Particular embodiments of the invention are set forth in the dependent claims. Further aspects, effects and details of the invention are described with reference to an example shown in the accompanying drawings.

Figure 2:
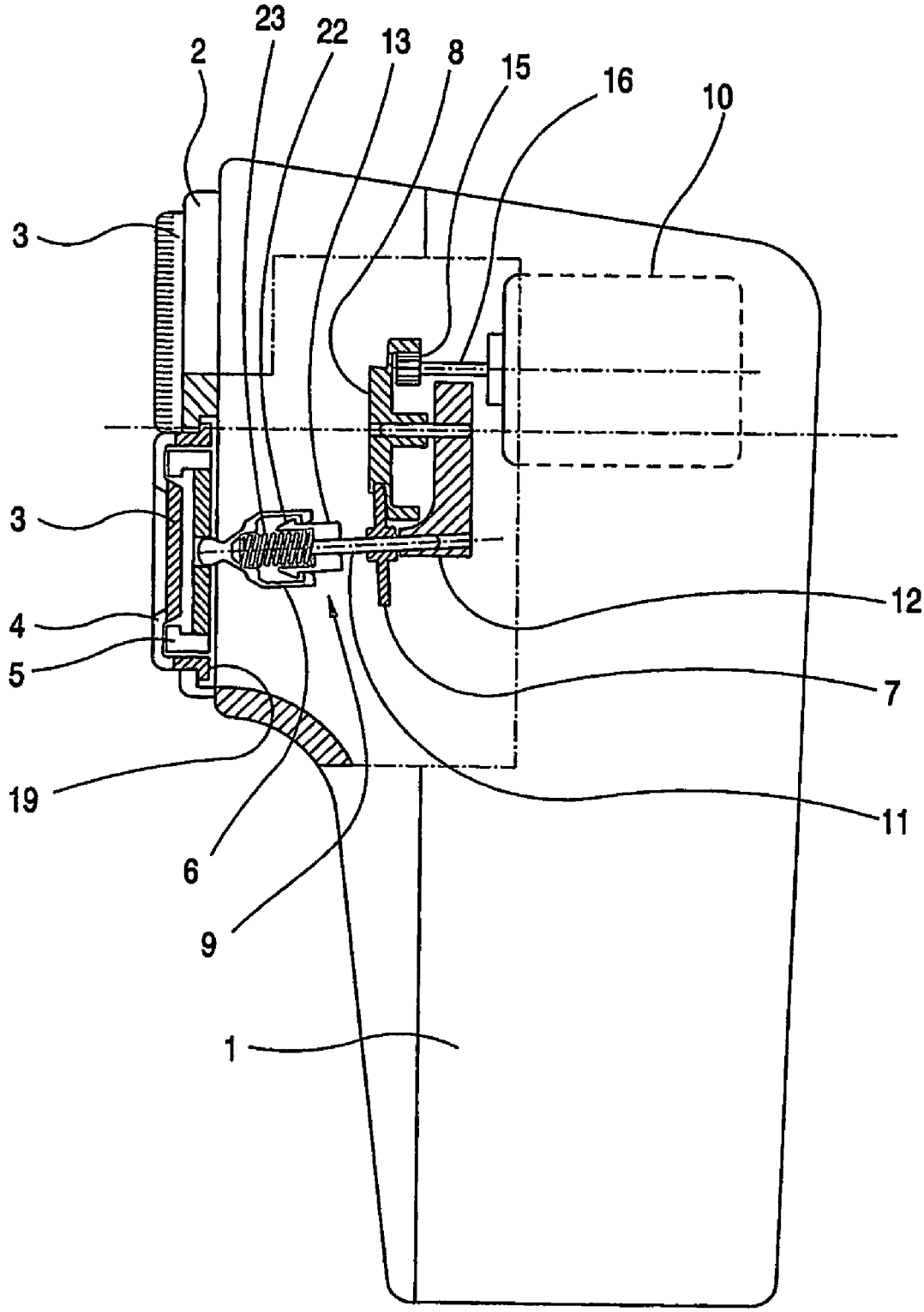
Figure 3:
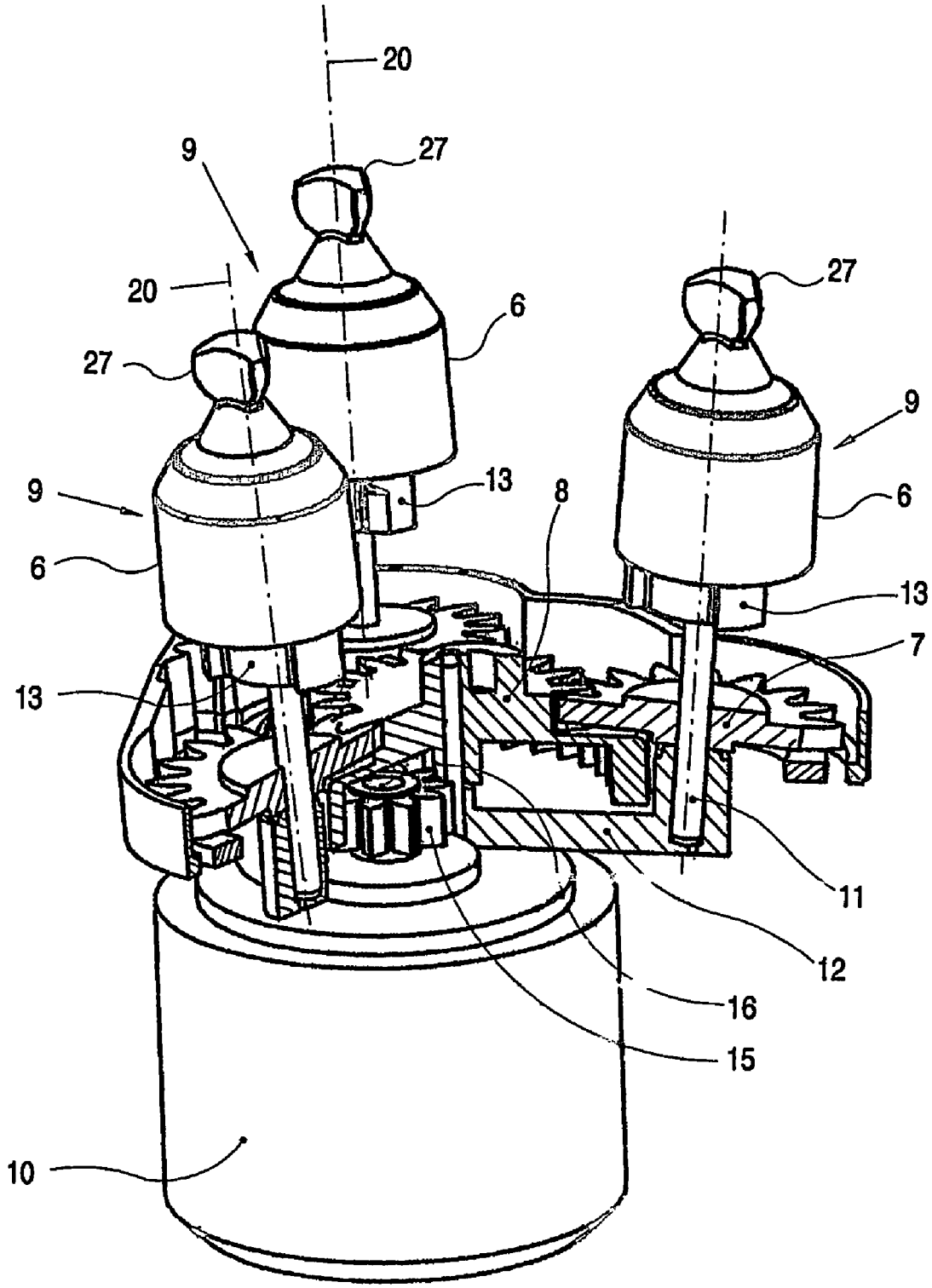
Figure 4:
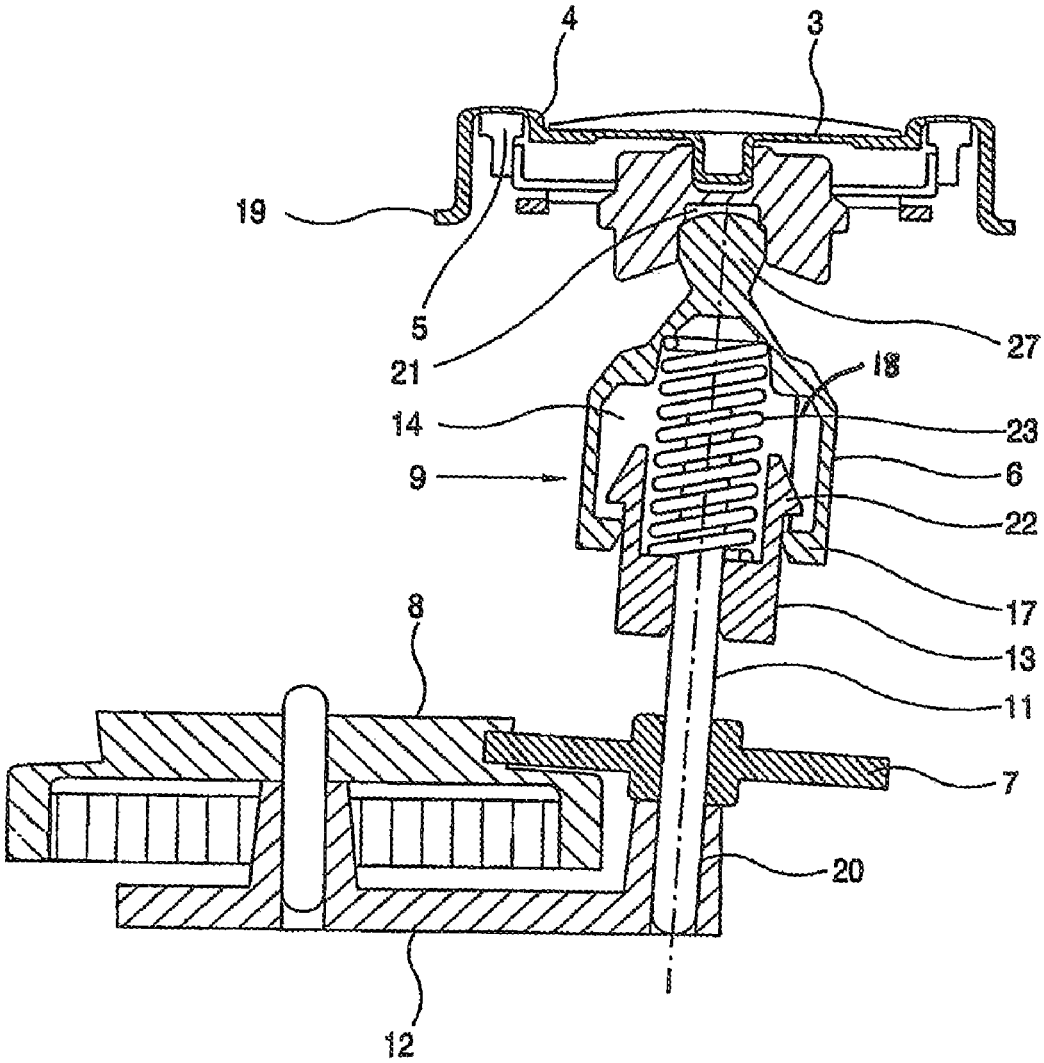
Figure 5:
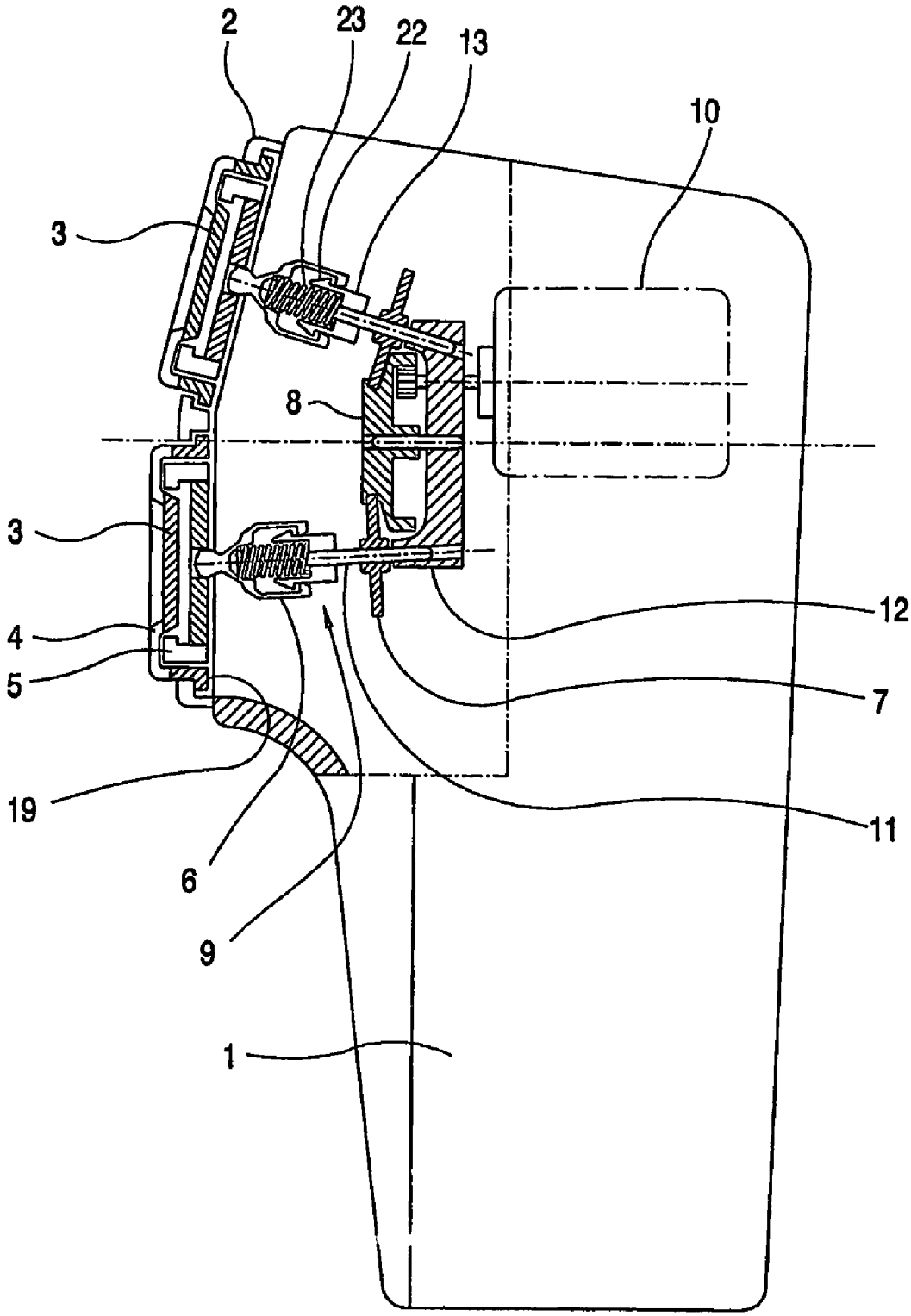

FIG. 1 is a somewhat schematical front elevation of a shaving apparatus according to an embodiment of the invention having three floating heads, FIG. 2 is a somewhat schematical side elevation of the shaving apparatus of FIG. 1, with one of the shaving heads shown in cross-section taken on the line II-II in FIG. 1, FIG. 3 is a cut-away perspective view of the motor and the drive structure of the apparatus according to FIGS. 1 and 2, FIG. 4 shows a schematical longitudinal section taken along the axes of rotation of a central gear wheel and the drive rim of one of the drive units, and FIG. 5 is a somewhat schematical side elevation of a shaving apparatus according to another embodiment of the invention with two of the shaving heads shown in cross-section along respective center lines.

Figure 6:
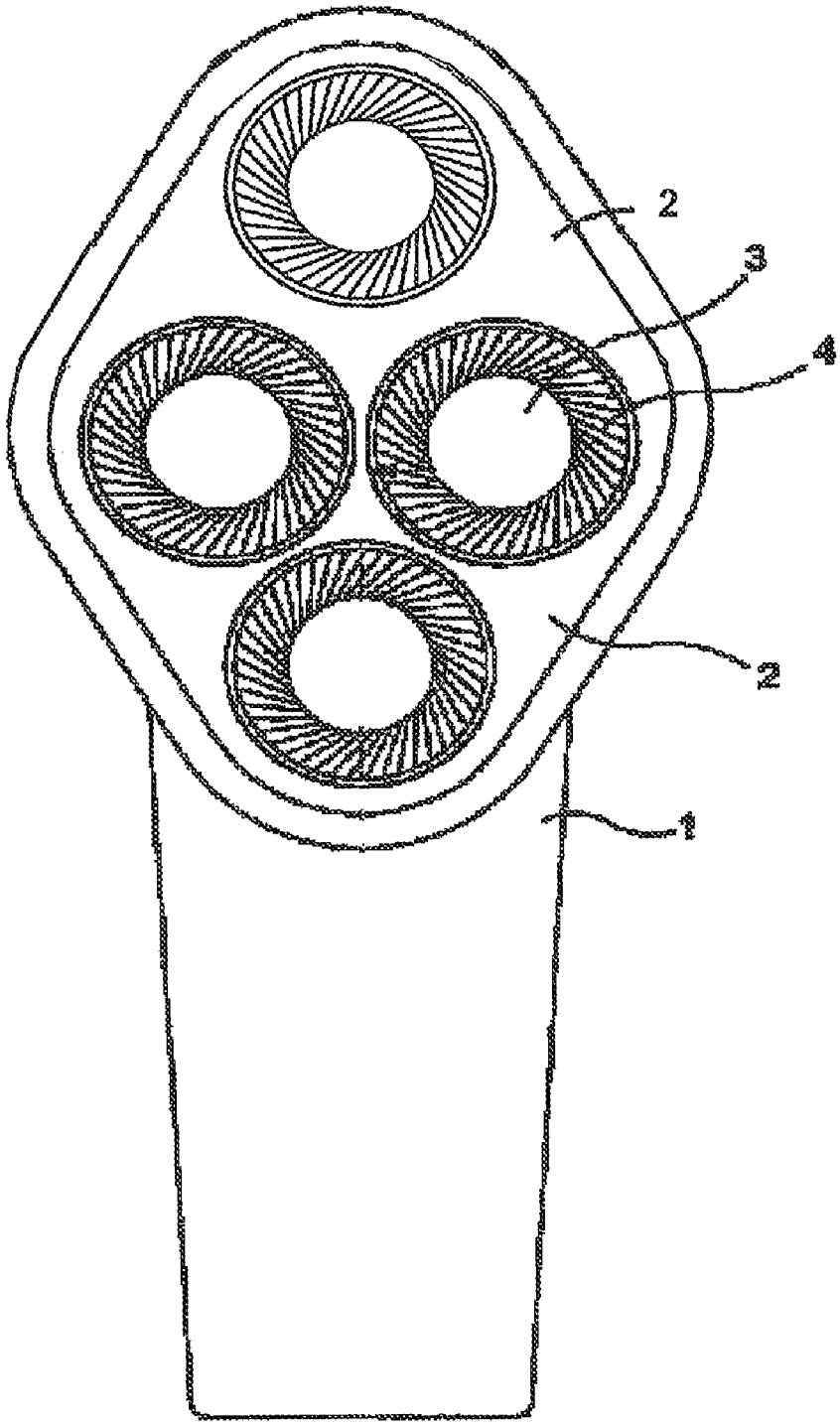

FIG. 6 is a somewhat schematically front elevation of a shaving apparatus according to an embodiment of the invention having more than three floating heads.

The shaving apparatus shown in FIGS. 1 and 2 comprises a housing 1 on which is mounted a shear-plate holder 2 for three shear plates 3. The shear plates 3 have hair entry apertures 4. A rotary cutting member 5 is situated on the inner side of each shear plate 3, for cooperation therewith in known manner.

The cutting members are rotated relative to the respective shear plates by a drive structure comprising an electric motor 10 and a transmission, to which the cutting members 5 are each coupled. The cutting members 5 are each coupled to an associated coupling spindle 6. In their turn, the spindles are each coupled to a drive rim 7. According to the present example, the drive rim is a toothed rim engaged by a gear wheel, but in principle the drive rim may also be designed to be engaged in other manners, such as by friction, by a pulley, by a belt, or by a drive chain. A central gear wheel 8 is journaled centrally between the toothed rims 7, and an upper, outwardly facing gear engages each of the tooted rims. A pinion 15 fixed on the motor shaft 16 engages an inwardly facing gear of the gear wheel 8. The toothed rims 7 and an associated shaft 11 are each rotatably journaled in a mounting plate 12.

To each shaft 11, a hub 13 is connected of which click fingers 22 each extend into an associated one of the spindles 6 and engage an inwardly facing rim 17 to keep the hubs 13 and the associated spindles 6 together when the shear plate holder 2 is dismounted. A compression coil spring 23 is mounted inside a cavity 14 formed by axial bores in the spindle 6 and in the hub 13, which coil presses the coupling end 27 of the spindle 6 into engagement with the cutting member 5 or at least with a coupling member for driving the cutting member. The coil spring 23 exerts a force on the spindle 6 in the direction of the associated cutting member 5. This force is transmitted to the cutting member 5 by the coupling spindle 6 and via the cutting member 5 to the associated shear plate 3, the flanged edge 19 of which is thereby pressed against the shear-plate holder 2. In use, the shear plates 3, together with the associated cutting members 5 and coupling spindles 6, can be pressed inwards against the action of the springs 23, under the pressure of which the shear plates are held against the user's skin.

All three cutting members 5, are coupled to the drive motor 10 in the above manner, the three toothed rims 7 nesting with the single centrally disposed gear wheel 8.

Ribs or grooves 18 are formed on the wall of the cavity in each spindle and cooperate with ribs or grooves on the hub 13. Thus, a multi-point coupling (preferably having three or more point, line and/or surface contacts) is obtained between the hub 13 and the spindle 6 to transmit the rotary movement of the toothed rim 7 to the coupling end 27 of the spindle 6. The spindle 6 may be tilted relative to the toothed rim to accommodate to the position of the center of the cutting member 5 relative to the axis of rotation 20 of the toothed rim 7, for instance to assume a position that is slightly angled relative to the axis of rotation 20 of the toothed rim 7.

The coupling end 27 of each coupling spindle 6 remote from the hub 13 is triangular and bears on a wall of a correspondingly shaped recess 21 in the cutting member 5. The spindle 6 is thus also coupled to the cutting member 5 by a multi-point coupling, which will permit a tilting movement of the coupling spindle and the cutting member relative to each other.

The axes of rotation 20 of the drive rims 7 are oriented at angles relative to each other and diverge from each other in a direction from the drive rim 7 to the coupling end 27. This allows the centers of the toothed rims 7 to be closer together tan the centers of the cutting members 5 and hence provides a more compact and lightweight construction with smaller drive wheels, without entailing the disadvantage of a relatively large angle between the spindle 6 and the cutting member 5 or the disadvantage of a substantial angle between the spindle 6 and the hub 13. This, in turn, reduces friction and wear in the transmission. The relatively small angle between the spindle 6 (or more generally, the drive unit) and the center line of the shaving head in its neutral position provides the advantage that the maximum angle between the cutting member 5 and the spindle 6 that can occur when the floating shaving head is tilted through a given angle from its neutral position, by pressing it inwards on one side, is reduced. Accordingly, the maximum angle through which the shaving heads are capable of tilting from their neutral positions is increased.

That the shaving heads can be tilted through a wider angle is especially useful for shaving apparatuses of which the shear-plate holder consists of a number of elements, such as floes or panels, that are tiltable with respect to each other.

FIG. 5 shows an apparatus of which the axes of rotation of the drive rims for the different shaving heads are oriented at different angles relative to each other.

The mutually angled configuration of the axes of rotation of the drive rims can be applied with particular advantage to apparatuses comprising more than three shear plates, resulting in a relatively large shear-plate holder, which may be flat or contain portions that extend at substantial angles relative to each other.

The angle between the axes of rotation of the toothed rims is preferably at least 3°. In particular if a generally convex design of the shear-plate holder is desired, the angle between the axes can be quite large, for instance up to 20 or 45°. The preferred angle for a shaver with an average, customary shear-plate holder is about 8 to 10°.

To drive the cutting members 5 of all shaving heads uniformly, the axis of rotation of the central gear wheel 8 preferably extends centrally between the axes of rotation of the toothed rims 7 of the drive units 9 and at the same angle to each of the axes of rotation 20 of the toothed rims 7.

The invention claimed is:

1. A shaving apparatus comprising:

a housing;

a plurality of shaving heads included in the housing, each comprising a circular shear plate provided with hair-entry apertures; a rotatable cutting member associated with and rotatable relative to the shear plate, a sheer-plate holder mounted on the housing, the sheer-plate holder holding the plurality of shear plates;

a motor included in the housing, and a drive structure coupling said motor to said cutting members for driving the cutting members into rotation, said drive structure comprising a plurality of drive units, each of said drive units extending at least from a drive rim engaged for driving the drive unit to a coupling end coupled to one of said cutting members for transferring rotation of the drive unit to the cutting member, wherein at least the drive rims of the drive units are each suspended for rotation about an axis of rotation, and wherein the axes of rotation of said drive rims are oriented at angles relative to each other and diverge from each other in a direction from the drive rim to the coupling end.

2. An apparatus according to claim 1, in which the angle between said axes of rotation of said drive rims is at least 3°.

3. An apparatus according to claim 1, in which at least two of said angles between axes of rotation of said drive rims are different from each other.

4. The apparatus of claim 1, in which the angle between said axes of rotation of said drive rims is between 8° and 10°.

5. The apparatus of claim 1, in which the angle between said axes of rotation of said drive rims is between 20° and 45°.

6. A shaving apparatus comprising:

a plurality of shaving heads included in a housing, each comprising a circular shear plate held by a sheer-plate holder and provided with hair-entry apertures, the sheer-plate holder being mounted on the housing;

a rotatable cutting member associated with and rotatable relative to the shear plate, a motor included in the housing, and a drive structure coupling said motor to said cutting members for driving the cutting members into rotation, said drive structure comprising a plurality of drive units, each of said drive units extending at least from a drive rim engaged for driving the drive unit to a coupling end coupled to one of said cutting members for transferring rotation of the drive unit to the cutting member, and a central gear wheel engaging said drive rims, wherein at least the drive rims of the drive units are each suspended for rotation about an axis of rotation, said central gear wheel being rotatable about an axis of rotation extending between the axes of rotation of said drive rims of said drive units, and wherein the axes of rotation of said drive rims are oriented at angles relative to each other and diverge from each other in a direction from the drive rim to the coupling end.

7. An apparatus according to claim 6, wherein the shear plates extend at angles with respect to each other.

8. The apparatus of claim 6, in which the axis of rotation of the central gear wheel extends at a same angle with respect to axes of rotation of each of the drive rims.

9. The apparatus of claim 6, in which the angle between said axes of rotation of said drive rims is at least 3°.

10. The apparatus of claim 6, in which the angle between said axes of rotation of said drive rims is between 8° and 10°.

11. The apparatus of claim 6, in which the angle between said axes of rotation of said drive rims is between 20° and 45°.

* * * * *